United States Patent [19]

Liotta

[11] 4,259,168

[45] Mar. 31, 1981

[54] TREATMENT OF COAL TO INCREASE YIELDS AND IMPROVE PHYSICAL CHARACTERISTICS OF COAL LIQUEFACTION DISTILLATES AND BOTTOMS

[75] Inventor: Ronald Liotta, Clark, N.J.

[73] Assignee: Exxon Research and Engineering Co., Florham Park, N.J.

[21] Appl. No.: 69,064

[22] Filed: Aug. 23, 1979

Related U.S. Application Data

[63] Continuation-in-part of Ser. No. 969,352, Dec. 14, 1978, abandoned.

[51] Int. Cl.[3] ..... C10G 1/00; C10B 57/04

[52] U.S. Cl. ..... 208/8 LE; 208/9; 201/20; 44/1 R

[58] Field of Search ..... 208/8 LE, 9; 201/20; 44/1 R

[56] References Cited

U.S. PATENT DOCUMENTS

| | | | |
|---|---|---|---|
| 2,378,762 | 6/1945 | Frey | 208/46 |
| 3,992,432 | 11/1976 | Napier et al. | 260/465.1 |
| 4,059,410 | 11/1977 | Schlosberg et al. | 44/1 R |
| 4,072,475 | 2/1978 | Schlosberg et al. | 44/1 R X |
| 4,089,772 | 5/1978 | Gorbaty et al. | 208/8 LE |
| 4,092,235 | 5/1978 | Schlosberg et al. | 208/8 LE |

FOREIGN PATENT DOCUMENTS

| | | |
|---|---|---|
| 851191 | 5/1977 | Belgium . |
| 2634419 | 10/1977 | Fed. Rep. of Germany . |

OTHER PUBLICATIONS

Heathcoat et al., J.C.S., 1932, pp. 2839–2843.
Kröges et al., Erdöl und Kohle ERDGAS Petrochemie 18 JAHRG NR5 MAK 1965.
Sokolova, Chem. Ab., vol. 48, p. 3672i (1954).
Fujossi et al. 1962, p. 4946.
Hodek et al., Fuel, 1973, vol. 52, Jul., pp. 220–225.
Hodek et al., ACS Div. of Pet. Chem. 22(2), 462 (1977).
Allemen, Analytica Chem., vol. 24, No. 9, Sep. 1952.
Mazumdar et al., Fuel 36, 254–256 (1957).
Brandstrom et al., Acta. Chem. Scand. 23 (1969) No. 6.
Wagenknecht et al., Synthetic Communication 2(4), 215–219 (1972.
A. McKillop et al., Tetrahedron, vol. 30, pp. 1379–1382 (1974).
Bashall et al., Tetrahedron Letters, No. 40, pp. 3489–3490, (1975).
Dehmlow et al., Tetrahedron Letters, No. 2, pp. 95–96 (1976).
Blom et al., Fuel, 36, 135 (1957).
Yohe et al., J.A.C.S., vol. 69, pp. 2644–2648.
Sternberg et al., Fuel 53, 172–175 (1974).
Nandi et al., J. of Ind. Chem. Soc. Ind. & New Ed., vol. 20, No. 2, (1957).
Nandi et al., Jour of Indian Chem Soc. Ind. & News Ed., vol. 20, #3 & 4 (1957).
Ray et al., J. Sci. Indust. Res., vol. 183, Nov. 1959, pp. 492–493.
Banerjee et al., J. Sci. Ind. Research 19B (1960).
Sen et al., J. Sci & Ind. Research India 19B (1960).

*Primary Examiner*—Delbert E. Gantz
*Assistant Examiner*—William G. Wright
*Attorney, Agent, or Firm*—D. W. Collins; Henry E. Naylor

[57] ABSTRACT

Treatment of weakly acidic protons in coal by oxygen-alkylation or oxygen-acylation employing a phase transfer reaction under mild conditions increases the yield, lowers the viscosity and boiling ranges of coal liquefaction distillates and renders these coal liquids more compatible with petroleum liquids. The process also improves the compatibility with petroleum liquids of the coal liquefaction bottoms and their solubility in common organic solvents.

The phase transfer reaction chemically alters phenolic and carboxylic functional substituents. These two very polar functional groups are converted to relatively non-polar ethers and esters, respectively. The O-alkylation or O-acylation is carried out in a binary liquid phase solution (organic and water phases with a solid phase suspended in the medium). A quaternary ammonium or phosphonium salt is reacted with alkali or alkaline earth base (caustic) to produce the corresponding quaternary ammonium or phosphonium base (an example of a phase transfer reagent). This quaternary base is non-nucleophilic and readily removes the phenolic and carboxylic protons, but does little else to the coal structures. After the removal of the weakly acidic protons by the quaternary base, the phenoxides and carboxylates which are produced then under O-alkylation or O-acylation. The alkylating or acylating agent comprises a carbon-bearing functional group and a displaceable leaving group.

22 Claims, 1 Drawing Figure

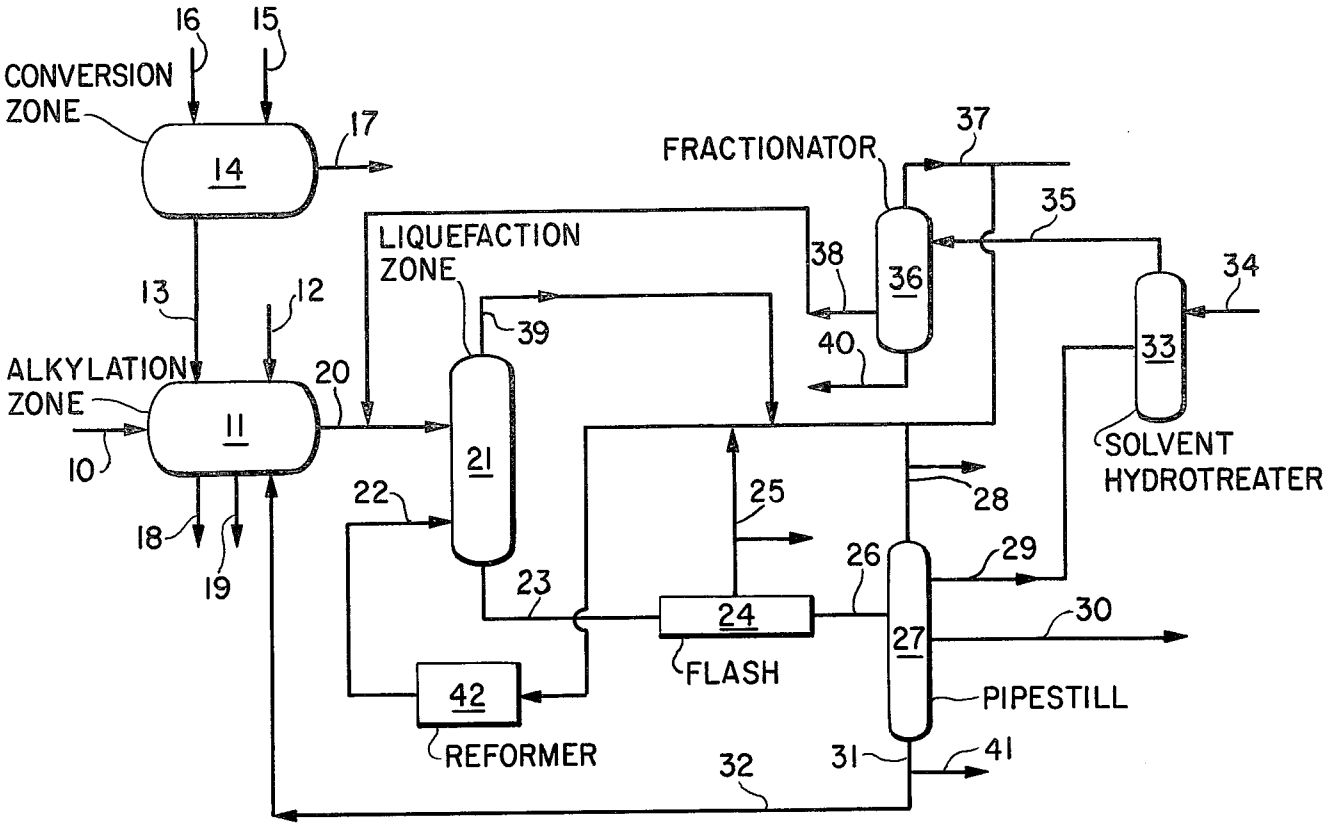
CONVERSION ZONE
ALKYLATION ZONE
LIQUEFACTION ZONE
FRACTIONATOR
SOLVENT HYDROTREATER
PIPESTILL
FLASH
REFORMER
10
11
12
13
14
15
16
17
18
19
20
21
22
23
24
25
26
27
28
29
30
31
32
33
34
35
36
37
38
39
40
41
42

TREATMENT OF COAL TO INCREASE YIELDS AND IMPROVE PHYSICAL CHARACTERISTICS OF COAL LIQUEFACTION DISTILLATES AND BOTTOMS

CROSS-REFERENCE TO RELATED APPLICATIONS

This is a continuation-in-part application of Ser. No. 969,352, filed Dec. 14, 1978 now abandoned.

BACKGROUND OF THE INVENTION

1. Field of the Invention

This invention is directed to improving properties of coals and, in particular, to improving yields and physical characteristics of coal liquefaction distillates and bottoms.

2. Description of the Prior Art

Much work has been done in recent years to make useful liquids and gases from coal. Various types of liquefaction processes have been developed, such as solvent refining, direct hydrogenation with or without a catalyst, catalytic or non-catalytic hydrogenation in the presence of a non-donor solvent, and catalytic or non-catalytic liquefaction by the donor solvent method. Exemplary of the solvent hydrogen donor liquefaction process is U.S. Pat. No. 3,617,513.

In an effort to increase liquefaction yields, a number of ancillary processes have been developed, such as pretreatment of coal prior to the liquefaction process or post-treatment of products derived from the liquefaction process, e.g., liquefaction distillates, coal liquids and bottoms. Exemplary of pretreatment processes is U.S. Pat. No. 4,092,235, which discloses acid-catalyzed Friedel-Crafts C-alkylation or C-acylation of coal to increase the yield of products from coal liquefaction. The introduction of aliphatic hydrocarbon radicals or acyl radicals, including carbon monoxide, into the coal structure is believed to permit a greater quantity of the coal to undergo liquefaction at suitable liquefaction conditions. The alkylation or acylation reactions, which may be conducted in the presence or absence of added or extraneous catalysts, take place at carbon sites.

Many of the C-alkylation and C-acylation processes require a considerable amount of alkylating or acylating agent in order to accomplish their purpose. Further, during the subsequent coal liquefaction process, phenols present in the coal are cleaved to produce water. In liquefaction processes employing hydrogen, an excessive use of hydrogen thus occurs.

SUMMARY OF THE INVENTION

In accordance with the invention, coal liquefaction distillates and bottoms having improved properties are formed by a process which comprises (a) treating functionalities having weakly acidic protons in coal by a process selected from the group consisting of alkylation and acylation, and (b) subjecting the treated coal to liquefaction process. Weakly acidic protons include phenolic, carboxylic and mercaptan functionalities. The O-alkylation or O-acylation is conveniently carried out by use of a phase transfer reagent and an alkylating or acylating agent. The phase transfer reagent, which is recyclable, is, by way of example, a quaternary ammonium or phosphonium base ($R_4QOR''$), where R is the same or different group selected from the group consisting of $C_1$ to about $C_{20}$ alkyl and $C_6$ to about $C_{20}$ aryl; Q is nitrogen or phosphorus; and R'' is selected from the group consisting of hydrogen, $C_1$ to about $C_{10}$ alkyl, aryl, alkylaryl, arylalkyl and acetyl. The alkylating and acylating agents are represented by the formula R'X where R' is a $C_1$ to $C_{20}$ alkyl or acyl group and X is a leaving group selected from the group consisting of halide, sulfate, bisulfate, acetate and stearate, wherein X is attached to a primary or secondary carbon atom.

The O-alkylated or O-acylated coal is then subjected to a coal liquefaction process to produce distillable coal liquids. These coal liquids are formed in greater yields and have more desirable properties than those formed from the same liquefaction process but using untreated coal. The improved physical properties of these coal liquids are reduced viscosity, lower boiling ranges and increased compatibility with petroleum liquids. The excessive use of hydrogen to produce water is also avoided in the liquefaction of O-alkylated and O-acylated coals employing hydrogen-based liquefaction schemes.

BRIEF DESCRIPTION OF THE DRAWING

The FIGURE schematically illustrates one process for effecting and utilizing this invention.

DETAILED DESCRIPTION OF THE INVENTION

The procedure that follows is especially useful for the selective O-alkylation or O-acylation of bituminous, subbituminous and lignite coals usually employed in liquefaction processes. The phenolic and carboxylic functional substituents in the coal are chemically altered. These two very polar functional groups are converted to relatively non-polar ethers and esters, respectively. The chemical transformation may be represented as follows:

$$\text{Ar—OH} + \text{R'X} \rightarrow \text{Ar-OR'}$$

$$\text{Ar—COOH} + \text{R'X} \rightarrow \text{Ar-COOR'}$$

where R' is a $C_1$ to about $C_{20}$ alkyl or acyl group.

The O-alkylation or O-acylation of solid coal by reagents which are in liquid solution is greatly influenced by use of a phase transfer reagent. Such a reagent has both lipophilic and a hydrophilic portion and is capable of transferring a basic species, —OR'', from an aqueous phase to either a solid or liquid organic phase, where R'' is either hydrogen for a carbon-bearing functionality. The phase transfer reagent may be generated catalytically, in which case the process is termed a phase transfer catalysis, which is a well-known reaction; see, e.g., Vol. 99, Journal of the American Chemical Society, pp. 3903–3909 (1977). Alternatively, the reagent may be generated in a separate step, then used in the alkylation or acylation reaction. If this latter reaction is employed, then the active form of the reagent may be regenerated in a subsequent step. In either case, the overall chemical transformation on the solid coal is the same. A generalized mechanistic scheme of this transformation is shown below:

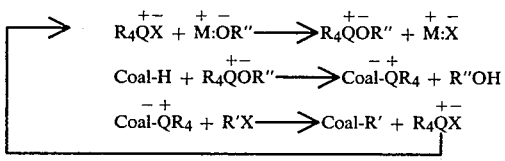

The phase transfer reagent is preferably a quaternary base represented by the formula $R_4QOR''$ where each R is the same or different group selected from the group consisting of $C_1$ to about $C_{20}$, preferably $C_1$ to $C_6$ alkyl and $C_6$ to about $C_{20}$, preferably $C_6$ to $C_{12}$ aryl group; Q is nitrogen or phosphorus, preferably nitrogen, and R" is selected from the group consisting of hydrogen, $C_1$ to about $C_{10}$, preferably $C_1$ to $C_6$ alkyl, aryl, alkylaryl, arylalkyl and acetyl group; more preferably a $C_1$ to $C_4$ alkyl group and most preferably hydrogen. The phase transfer reagent may be generated by reacting the corresponding quaternary salt $R_4QX$ with a metal base MOR" where X is selected from the group consisting of halide, sulfate, bisulfate, acetate and stearate. Preferred is when X is a halide selected from the group consisting of chlorine, bromine and iodine, more preferably chlorine. M is selected from the group consisting of alkali metals, more preferably sodium and potassium. As shown above, the quaternary base is then reacted with the acidic groups on the coal which in turn is reacted with at least one alkylating or acylating agent represented by the formula R'X wherein R' is selected from the group consisting of $C_1$ to about $C_{20}$ alkyl or acyl group and X is as previously defined, as long as X is attached to a primary or secondary carbon atom. Preferably R' is an inert hydrocarbon, that is, a hydrocarbon group containing only hydrogen and carbon although hydrocarbon groups containing other functionality may also be suitable for use herein, even though less desirable. It will be noted that the acidic proton H (hydrogen atom) is usually located on phenolic groups for lower rank coals. The acidic proton may also be located to a lesser extent on sulfur, nitrogen, etc.

Phase transfer reagents such as quaternary ammonium base ($R_4QOR''$) are very effective with O-alkylation and O-acylation of coal. These O-alkylation and O-acylation reactions are successful because the —OR" portion of the molecule is soluble in an organic medium. When this base is present in such a medium, it is not solvated by water or other very polar molecules. As an unsolvated entity, it can react as a very efficient proton transfer reagent. For example, $$(\text{coal})\text{—OH} + \bar{O}R'' \rightarrow (\text{coal})\text{—}\bar{O} + R''OH$$

This unsolvated base (also known as a "naked hydroxide" when R" is hydrogen) can have a wide variety of counter ions. Although the counter ion may be quaternary ammonium or phosphonium species as previously discussed, other examples of counter ions useful in the practice of the invention include "crown ether" complexes of a salt containing the OR" anion and clathrate compounds, complexed with a salt containing the OR" anion. Salts represented by MOR", where M is as given above, when complexed with crown ethers, for example, have been previously demonstrated to evidence a reactivity similar to that found for $R_4QOR''$ compounds.

In one embodiment of the process of the invention, a two-phase solid/liquid system comprising the particular coal in liquid suspension is formed. The coal is generally ground to a finely divided state and contains particles less than about ¼ inch in size, preferably less than about 8 mesh NBS sieve size, more preferably less than about 80 mesh. The smaller particles, of course, have greater surface area and thus alkylation or acylation will proceed at a faster rate. Consequently, it is desirable to expose as much coal surface area as possible without losing coal as dust or fines or as the economics of coal grinding may dictate. Thus, particle sizes of greater than about 325 mesh are preferred.

Although not necessary, a solvent may be added if desired. The solvent may be used to dissolve alkylated or acylated carbonaceous product or to dissolve alkylating or acylating agent (especially if the agent is a solid and is comparatively isoluble in water). The solvent may also be used for more efficient mixing. Many of the common organic solvents may be employed in any reasonable amount, depending on the desired result.

Inasmuch as there are solid coal particles which never dissolve during the course of the reaction, there may be some concern as to the extent of the reaction on these particles. To verify the complete extent of the reaction, these particles were collected and worked up separately on numerous runs with a wide variety of alkylating agents as well as coals. Infrared spectral analysis of this insoluble portion of the coal reaction mixture showed that in every case, substantially complete alkylation of the hydroxyl group had occurred. This is evidence that the phase transfer reagent must have penetrated the solid coal structure and that the resulting organic salt of the coal must have reacted with the alkylating agent to produce the observed product. Thus, the etherification and esterification reactions are not merely taking place on the surface of the coal but throughout the coal structure as well.

The phase transfer reagent that is used must dissolve in or be suspended in both phases so that it is in intimate contact with both the organic and aqueous phases. During the course of the reaction, the phase transfer reagent will partition itself into both of these phases. Quaternary bases are one class of compounds useful as phase transfer reagents in the practice of the invention and are given by the formula $R_4QOR''$, where R is an alkyl group having at least one carbon atom, and preferably 1 to 20 carbon atoms, and more preferably 1 to 6 carbon atoms or an aryl group having 6 to 20 carbon atoms, preferably 6 to 12 carbon atoms. The lower number of carbon atoms is preferred, since such compounds are water soluble and can be removed from the alkylated or acylated coal by simple water washing. The R groups may be the same or different. Examples of B groups include methyl, butyl, phenyl and hexadecyl.

Examples of quaternary bases useful in the practice of the invention include the following:

1. Tetrabutylammonium hydroxide $(C_4H_9)_4NOH$
2. Benzylhexadecyldimethylammonium hydroxide, $(C_6H_5CH_2)(C_{16}H_{33})(CH_3)_2NOH$
3. Tetrabutylphosphonium hydroxide, $(C_4H_9)_4POH$
4. ADOGEN 464, $(C_8\text{–}C_{10})_4NOH$ (ADOGEN 464 is a trademark of Aldrich Chemical Company, Metuchen, N.J.)

The metal base used to convert the quaternary salt to the corresponding base is an alkali metal or alkaline earth metal base such as NaOH, KOH, $Ca(OH)_2$ or $NaOCH_3$. The use of an alkoxide, for example, permits use of the corresponding alcohol in place of water, which may provide an advantage in treating certain coals.

In chosing the alkylating and acylating reagent, two considerations must be weighed. First, it is desired to add longer chains to the coal which render the product more petroleum-like, and therefore more soluble in organic solvents and more compatible with petroleum liquids. On the other hand, shorter chains render the alkylated or acylated coal product more volatile. Second, shorter chain materials are less expensive and still improve solubility.

In the case of O-alkylation, the carbon to which the leaving group is attached may be either a primary or secondary carbon atom. Primary carbon halides have been found to react faster than the corresponding secondary halides in a phase transfer or phase transfer catalyzed reaction on carbonaceous materials and are accordingly preferred. While the balance of the carbon-bearing functional group may in general contain other moieties, such as heteroatoms, aryl groups and the like, bonding of the carbon-bearing functional group to the phenolic or carboxylic oxygen is through either an $sp^3$ hybridized carbon atom (alkylation) or an $sp^2$ hybridized carbon atom (acylation). Further, a mixture of alkylating or acylating agents or a mixture of both may be advantageously employed. Such mixtures are likely to be generated in coal-treating plants in other processing steps and thus provide a ready source of alkylating and/or acylating agents. Examples of alkylating and acylating agents useful in the practice of the invention include ethyl iodide, isopropyl chloride, dimethyl sulfate, benzyl bromide and acetyl chloride.

While alkylating and/or acylating agents are employed in the practice of the invention, alkylating agents are preferred for the following reasons. First, alkylating agents are readily prepared from their hydrocarbon precursors. For example, alkyl halides may be easily prepared by free radical halogenation of alkanes, which is a well-known process. When a system containing more than one alkylating or acylating agent is used, the hydrocarbon precursor is preferably a product stream of a certain cut derived from coal and petroleum processing and the like. This stream may contain minor amounts of components having various degrees of unsaturation which are also suitable for reacting with the phenolic and carboxylic groups herein as long as X (as previously defined) is attached to an alkyl or saturated carbon atom in the resulting alkylating or acylating agent. Second, acylating reagents are susceptible to hydrolisis. Since water is ever present in coal and other solid carbonaceous material and is employed in the inventive process, some loss of acylating agent may occur by hydrolisis. In contrast, alkylating reagents do not evidence the same susceptibility to hydrolisis.

If the O-alkylation or O-acylation is carried out by a catalytic process, then the quaternary salt, metal base and alkylating or acylating agent are mixed directly with an aqueous slurry of coal. The quaternary salt catalyst may be present in small amounts, typically about 0.05 to 10 wt.% of the amount of coal used; however, greater amounts may also be employed. The metal base and alkylating or acylating agent must be present in at least stoichiometric quantities relative to the number of acidic sites (phenolic, carboxylic, etc.) on the coal, but preferably an excess of each is used to drive the reaction to completion. Advantageously, a two-fold excess of metal base and alkylating or acylating agent is employed; however, a greater excess may be employed. After the reaction, the excess quaternary base and quaternary salt catalyst may be removed from the coal by ample water washing for recycling. Excess metal base will also be extracted into the water wash and may be reused. Excess alkylating or acylating agent may be conveniently removed from the treated coal by fractional distillation or by solvent extraction with pentane or other suitable solvent and may be reused.

To cap off all acidic protons in a typical coal employed in the catalytic process, less than 5 days are required for 100% conversion, employing only a slight excess of alkylating or acylating agent on 80/100 mesh coal under atmospheric pressure and ambient temperature. A greater excess of alkylating or acylating agent will reduce the reaction time considerably.

A faster alkylation or acylation reaction may be obtained in a number of ways, one of which is to add the phase transfer reagent ($R_4QOR''$) directly to the coal rather than to form this reagent in situ with the reaction in which coal is alkylated or acylated. When this is done, substantially complete conversion of all the phenolic and carboxylic groups are achieved in a matter of minutes. The amount of quaternary base added ranges from about stoichiometric proportions to about 10 times the total number of acidic sites on the coal which are capable of undergoing alkylation or acylation. As before, the quaternary salt that is generated in the alkylation or acylation step may be recovered and recycled by reacting it with fresh metal base to regenerate the quaternary base. By employing this two-step process, there is no contact between metal base and the coal, and the reaction is essentially complete in about one hour.

As an example, in 10 g of Illinois No. 6 coal, there are 35 mmoles of Ar—OH groups. An excess of a quaternary hydroxide along with an excess of an alkylating agent (about 4 to 5 times each) results in essentially complete alkylation in less than one hour at ambient conditions. In contrast, in the phase transfer catalyzed reaction, there is metal base present so that the alkylation (or acylation) must be carried out in an inert atmosphere, such as nitrogen, to avoid oxidation of the coal. In the case of the noncatalyzed process in which the formation of the transfer reagent is kept separate from the alkylating or acylating reaction, the rate of oxidation of the coal is slow enough and is not competitive with the alkylation or acylation reaction. Therefore, another advantage of this noncatalyzed process is that the use of an inert atmosphere such as nitrogen is not required.

The temperature at which the reaction is carried out may range from ambient to the boiling point of the materials used. Increased temperature will, of course, speed up the reaction rate.

The reaction mixture may be stirred or agitated or mixed in some fashion to increase the interface or surface area between the phases, since there can be aqueous, organic liquid and solid coal phases present.

The reaction is carried out at ambient pressure, although low to moderate pressures (about 2 to 20 atmospheres) may be employed along with heating to increase the reaction rate.

Once the reagents and solvents, if any, are removed from the alkylated or acylated coal, infrared analysis may be conveniently used to demonstrate that all the hydroxyl groups have been alkylated or acylated. If the added alkyl or acyl group is IR-active, then the appearance of the appropriate infrared frequency is observed. Other well-known analytical methods may also be employed if desired. The ultimate analysis of percent C, H, N, S and O is altered in a fashion which is consistent with the expected change due to the added alkyl or acyl substituent. For example, the increase in the H/C ratio of O-methylated Illinois No. 6 coal idicates that 4.5 methyl groups per 100 carbon atoms are added to the coal. The H/C ratio of the untreated Illinois No. 6 coal is 0.84 and the H/C ratio after O-methylation by the process of the invention is 0.89.

The thermogravimetric analysis of the O-methylated coal shows a significant increase in volatile organic content over the untreated coal (38% versus 32%).

Subsequent to the alkylation or acylation reaction, the product is subjected to liquefaction. The products of the liquefaction process are usually light gases, liquid products and a bottoms fraction. It is contemplated that all or a portion of the remaining solid residue may be recycled from the liquefaction zone to the alkylation or acylation zone. Separation of the solids material can be carried out by any known means, such as filtration, vacuum distillation, centrifugation, hydroclones, etc., and preferably by vacuum distillation.

Various types of liquefaction may be employed, such as solvent refining, as exemplified by the PAMCO process developed by the Pittsburgh and Midway Coal Company, direct hydrogenation with or without a catalyst, catalytic or noncatalytic hydrogenation in the presence of a nondonor solvent, catalytic or noncatalytic liquefaction by the donor solvent method, the latter being preferred particularly with the presence of hydrogen during the liquefaction step. One solvent hydrogen donor liquefaction process is described in U.S. Pat. No. 3,617,513. As used herein, liquefaction means the molecular weight degradation of coal as distinguished from mere solvent extraction where essentially no molecular weight degradation takes place, e.g., extraction with solvents such as benzene, pyridine or tetrahydrofuran at room temperature or temperatures ranging up to the boiling point of the extractive solvent. Thus, substantial chemical reaction does not occur until the temperatures are raised above about 150° C., preferably above about 200° C. Liquefaction, as opposed to solvent extraction, is a more severe operation, maximizes light liquid yields, and involves substantial chemical reaction of the coal. Solvent extraction tends to maximize heavier liquid yields, e.g., fuel oil and higher boiling constituents while involving little or no covalent bond cleavages due to the temperatures involved, e.g., less than 200° C., preferably less than 150° C., still more preferably less than 115° C. Additionally, maximizing light liquid yields allows for separation of the bottoms by distillation, e.g., vacuum distillation, rather than by filtration, which is used for solvent refined coals.

Briefly, hydrogen donor solvent liquefaction utilizes a hydrogen donating solvent which is composed of one or more donor compounds such as indane, $C_{10}$–$C_{12}$ tetralins, $C_{12}$–$C_{13}$ acenaphthenes, di-, tetra- and octahydroanthracenes and tetrahydroacenaphthene, as well as other derivatives of partially saturated hydroaromatic compounds. The donor solvent can be the product of the coal liquefaction process and can be a wide boiling hydrocarbon fraction, for example, boiling in the range of about 150° to 510° C., preferably about 190° to 425° C. The boiling range is not critical except insofar as a substantial portion of the hydrogen donor molecules are retained in the liquid phase under liquefaction conditions. Preferably, the solvent contains at least about 30 wt.%, more preferably about 50 wt.%, based on solvent, of compounds which are known hydrogen donors under liquefaction conditions. Thus, the solvent is normally comprised of donor and nondonor compounds.

Since the donor solvent can be obtained by hydrogenating coal liquids derived from liquefaction, for example, then the composition of the hydrogen donor solvent will vary depending upon the source of the coal feed, the liquefaction system and its operating conditions and solvent hydrogenation conditions. Further details of a hydrogenated liquefaction recycle stream are discussed in U.S. Pat. No. 3,617,513.

The coal is slurried in the hydrogen donor solvent and passed to a liquefaction zone wherein the convertible portion of the coal is allowed to disperse or react. O-alkylation and O-acylation of the coal by the process of the invention are believed to render more of the coal convertible as compared to untreated coal.

The solvent/coal ration, when about 50 wt.% of the solvent is hydrogen donor-type compounds, can range from about 0.5:1 to 4:1, preferably about 1:1 to 2:1. Preferably, the donor solvent contains at least about 25% hydrogen donor compounds, more preferably at least about 33% hydrogen donor compounds. Operating conditions can vary widely, that is, temperatures of about 310° to 540° C., preferably about 400° to 500° C. pressures of about 300 to 3000 psig, preferably about 1000 to 2500 psig; residence times of about 5 minutes to 200 minutes; and molecular hydrogen input of about 0 to 4 wt.% (based on DAF coal charged to the liquefaction zone in the slurry). The primary products removed from the liquefaction zone are light gases, liquid products and a slurry of unconverted coal and ash in the heavy oil. Since the liquid state products contain the donor solvent in a hydrogen depleted form, the liquid can be fractionated to recover an appropriate boiling range fraction which can then by hydrogenated and returned to the liquefaction zone as recycled, hydrogenated donor solvent.

Recycle solvent, preferably boiling in the range of about 175° to 425° C., separated from the liquid product of the liquefaction zone, can be hydrogenated with hydrogen in the presence of a suitable hydrogenation catalyst. Hydrogenation temperatures can range from about 340° to 450° C. pressures can range from about 650 to 2000 psig and space velocities of 1 to 6 weight of liquid per hour per weight of catalyst can be employed. A variety of hydrogenation catalysts can be employed such as those containing components from Group VIB and Group VIII, e.g. cobalt molybdate on a suitable support, such as alumina, silica, titania, etc. The hydrogenated product is then fractionated to the desired boiling range and recycled to the liquefaction zone or slurried with the coal prior to the liquefaction zone.

The coal liquids derived from liquefaction may be further processed, employing conventional refining techniques. The coal liquids will have a lower viscosity and boiling range and will be produced in higher yield and will be more compatible with petroleum liquids than coal liquids produced without the O-alkylation or O-acylation process of the invention. If the coal liquid is found still to be insufficiently compatible with certain petroleum liquids, however, the coal liquid may be alkylated or acylated in a separate zone, employing the alkylating or acylating procedures described above. The same ranges of conditions, reagents, concentrations and the like are advantageously employed to produce a coal liquid more compatible with petroleum liquids.

Light gases, such as CO, $CO_2$, $H_2S$ and light hydrocarbons generated by the liquefaction process may be collected and separated. Light hydrocarbon gases may be halogenated, such as by a free radical process, to form R'X compounds, which may be recycled to the alkylation or acylation zone, thereby providing at least a partial source of alkylating or acylating agent.

Coal bottoms from the liquefaction zone may be recycled to the alkylation or acylation zone. Alternatively, coal bottoms may be treated in a separate alkylation or acylation zone. Even if not further processed in this manner, the coal bottoms are more compatible with petroleum liquids and are more soluble in common organic solvents than untreated coal bottoms.

Referring now to the drawing, coal from storage is crushed and ground to less than about 8 mesh. Sufficient water is added to form an aqueous slurry of the coal which is introduced via line 10 to alkylation zone 11. It will be understood that an acylation zone may alternatively be employed, or indeed an alkylation/acylation mixture zone. An alkylating agent is introduced via line 12 and a quaternary base is introduced via line 13. The quaternary base is formed in conversion zone 14 by mixing metal base from line 15 and quaternary salts from line 16. Salt MX is withdrawn via line 17.

It is understood that alkylation zone 11 can be one or more alkylation reactions, interspersed by washing steps, into each of which fresh alkylating agent and quaternary base is introduced. Additionally, unreacted coal recovered from the liquefaction process can be recycled via line 32 for further treatment in the alkylation zone. Alkylated coal, substantially free of alkylating agent and quaternary base is dried (by equipment not shown), and then mixed with recycle solvent from line 38 to form a solvent/coal slurry in line 20 and fed to liquefaction zone 21 operating at a temperature of about 450° C. and 1500 psig. Hydrogen is fed to the liquefaction zone through line 22. A preheat furnace (not shown) is often desirable to heat the slurry to reaction temperatures by liquefaction.

Light gases, such as CO, $CO_2$, $H_2S$ and light hydrocarbons are removed from the liquefaction zone by line 39. The liquid product, in a slurry with unconverted coal, is recovered in line 23 and flashed in drum 24 to reduce the pressure, with light gases and light hydrocarbons being flashed off in line 25 and an oil/coal slurry being recovered in line 26. The light hydrocarbons from line 39 can be treated by conventional means to remove $CO_2$ and $H_2S$ and then sent to a conventional steam reforming furnace where the hydrocarbon gases are reformed to produce hydrogen for use in the process, such as in line 22 (and in line 34). The former, 42, can also be used to handle off gases from the pipestill 27 (line 28) and fractionator 36 (line 37). A portion of the light gases may be halogenated (apparatus not shown) and the alkyl halides formed may be used as a partial or total source of alkylating agent in line 12.

The product of line 26 is then treated in a fractionator 27 which can be an atmospheric or vacuum pipestill or both. Light gases are removed overhead in line 28 while a recycle solvent stream is removed via line 29 for treatment in solvent hydrotreater 33. Liquid product for upgrading by, e.g., catalytic cracking, is recovered in line 30. A product containing the residuum and unconverted coal (bottoms) is taken off by line 31, a portion of which can be recycled via line 32 to the alkylation zone, or treated in a separated alkylation zone and then recombined with the feed to the liquefaction zone. In a balanced process, some or all of the bottoms can be sent to hydrogen manufacture via line 41 to make hydrogen for use in the liquefaction zone and the solvent hydrotreater.

Recycle solvent is catalytically hydrogenated in hydrotreater 33, hydrogen being supplied in line 34, over a catalyst such as cobalt molybdate on an alumina support. Hydrotreated product is recovered in line 35 and fractionated in fractionator 36 from which recycle hydrogen donor solvent of the desired boiling range is recovered in line 38 and recycled to line 20 to slurry alkylated coal. Additional liquid product is recovered in line 40 and may be subjected to further upgrading. Any light gases formed during hydrotreating can be removed via line 37.

EXAMPLE 1

Phase Transfer Noncatalyzed Alkylation

Rawhide sub-bituminous coal was treated as follows: A slurry of 30.8 g Rawhide coal (−80 mesh) and 300 mmoles (free base) of tetrabutylammonium hydroxide (75% in aqueous solution) were mixed together at ambient temperature and 1 atm pressure for a few minutes. Tetrahydrofuran (200 ml) and 500 mmoles of n-heptyliodide were than added and the reaction mixture was stirred for nearly three hours. The colorless water layer was then separated and fresh water added to wash out any residual quaternary salt from the organic phase, which contained the O-alkylated coal. The washing was continued until the pH of the wash water was neutral and no precipitate formed when silver nitrate was added to the wash water. (A byproduct of the alkylation was tetrabutylammonium iodide, which reacted with the silver nitrate to give a precipitate of AgI). The excess heptyliodide, water and THF were removed by vacuum distillation at 100°-110° C. The alkylated coal was then analyzed. Infrared analysis revealed essentially complete elimination of the hydroxyl band (3100-3500 $cm^{-1}$), as well as incorporation of the alkyl ether funcitonality (1000-1200 $cm^{-1}$) and the ester carbonul functionality (1700-1735 $cm^{-1}$).

EXAMPLES 2-7

Phase Transfer NonCatalyzed Alkylation

The following runs were made, employing the procedure set forth in Example 1. In each reaction, the quaternary base was tetrabutylammonium hydroxide. The base was present in at least stoichiometric amount of the number of acidic protons on the coal sample in the case of Rawhide and 2:1 in the case Illinois No. 6.

TABLE II

PHASE TRANSFER NONCATALYZED REACTIONS

| Example | Coal(1) | R'X(2) | Reaction Time, hr. |
|---|---|---|---|
| 2 | Illinois #6 (80/100) | $CH_3I$, 200% | 1 |
| 3 | Illinois #6 (−80) | $C_4H_9I$, 200% | 3 |
| 4 | Illinois #6 (80/100) | $C_7H_{15}I$, 200% | 3 |
| 5 | Rawhide (80/100) | $CH_3I$, 200% | 1 |
| 6 | Rawhide (80/100) | $C_4H_9I$, 200% | 3 |
| 7 | Rawhide (80/100) | $C_7H_{15}I$, 200% | 3 |

Notes:
(1)Mesh size is indicated in parentheses
(2)Weight percent relative to coal

EXAMPLE 8

Phase Transfer Catalyzed Alkylation

Illinois No. 6 coal was treated as follows:

Twenty grams of Illinois No. 6 coal (80/100 mesh), 50 ml of a 50% aqueous NaOH solution, 150 ml of toluene, 70 mmoles of $CH_3I$ and 1 g of tetrabutylammonium chloride were mixed together under a nitrogen atmosphere (the order of addition was not important). After five days, the aqueous layer was separated and the organic phase washed with water until the unreacted sodium hydroxide and catalyst were extracted out of the toluene. The toluene, water and excess iodomethane were removed under vacuum at 100° C. The O-alkylated coal was then analyzed. Infrared analysis revealed essentially complete elimination of the hydroxyl band (3100–3500 $cm^{-1}$), as well as incorporation of the alkyl ether functionality (1000–1200 $cm^{-1}$) and incorporation of the ester carbonyl functionality (1700–1735 $cm^{-1}$).

EXAMPLES 9–35

Phase Transfer Catalyzed Alkylation

The following runs were made employing the procedure set forth in Example 8.

TABLE III

PHASE TRANSFER CATALYZED REACTIONS

| Example | Coal[1] | Solvent | Catalyst[2] | Caustic[3] | R'X[4] |
|---|---|---|---|---|---|
| 9 | Ill. #6 (−300) | Toluene | B, 10% | KOH, 50% | $Ch_3I$, 700% |
| 10 | Ill. #6 (−300) | Toluene | B, 10% | KOH, 50% | $C_2H_5I$, 500% |
| 11 | Ill, #6 (−100) | Toluene | B, 10% | KOH, 50% | $CH_3I$, 680% |
| 12 | Ill. #6 (−100) | Toluene | B, 10% | NaOH, 50% | $C_7H_{15}I$, 414% |
| 13 | Ill. #6 (−100) | Toluene | B, 10% | NaOH, 50% | Allylbromide, 420% |
| 14 | Wyodak (−100) | Toluene | B, 10% | NaOH, 50% | Allylbromide, 420% |
| 15 | Wyodak (−100) | Toluene | B, 10% | NaOH, 50% | $CH_3I$, 680% |
| 16 | Wyodak (−100) | Toluene | B, 10% | NaOH, 50% | Crotylbromide, 315% |
| 17 | Wyodak (−100) | Toluene | B, 10% | NaOH, 50% | $C_7H_{15}$, 414% |
| 18 | Wyodak (−100) | Toluene | B, 10% | NaOH, 50% | Cinnamylbromide, 500% |
| 19 | Ill. #6 (−100) | Toluene | B, 10% | NaOD, 40% | $CD_3I$, 137% |
| 20 | Ill. #6 (−100) | Toluene | B, 10% | NaOH, 50% | Propargylbromide, 375% |
| 21 | Wyodak (−100) | Toluene | B, 10% | NaOH, 50% | Propargylbromide, 624% |
| 22 | Wyodak (−100) | Toluene | B, 5% | NaOH, 50% | $(CH_3)_2SO_4$, 478% |
| 23 | Texas Lignite (−100) | Toluene | B, 10% | NaOH, 50% | Allylbromide, 450% |
| 24 | Ill. #6 (−100) | Toluene | B, 3.3% | NaOH, 12% | $C_4H_9Cl$, 427% |
| 25 | Ill. #6 (−100) | Toluene | B, 10% | NaOH, 20% | $C_3H_7I$, 388% |
| 26 | Ill. #6 (−80) | Xylenes | B, 10% | NaOH, 20% | 1-bromo-2-methyl, propane, 351% |
| 27 | Ill. #6 (−80) | Xylenes | A, 10% | NaOH, 20% | 2-iodopropane, 461% |
| 28 | Ill. #6 (−80) | Xylenes | T, 10% | NaOH, 12% | $CH_3I$, 540% |
| 29 | Ill. #6 (−80) | Toluene | T, 10% | NaOH, 12% | $CH_3I$, 50% |
| 30 | Ill. #6 (−80) | Toluene | T, 5.8% | NaOH, 12% | $CD_3I$, 72% |
| 31 | Ill. #6 (80/100) | Toluene | T, 5% | NaOH, 20% | $CD_3I$, 50% |
| 32 | Ill. #6 (80/100) | Toluene | T, 5% | NaOH, 20% | $C_4H_9I$, 100% |
| 33 | Ill. #6 (80/100) | THF | T, 5% | NaOH, 20% | $C_4H_9I$, 100% |
| 34 | Ill. #6 (300/325) | Toluene | T, 5% | NaOH, 20% | $C_4H_9I$, 100% |
| 35 | Ill. #6 (300/325) | THF | T, 5% | NaOH, 20% | $C_4H_9I$, 100% |

NOTES:
(1)Mesh size is indicated in parentheses
(2)B is benzylhexadecyldimethylammonium chloride, A is ADOGEN 464 and T is tetrabutylammonium iodide; weight percent is relative to coal
(3)Weight percent of caustic in water
(4)Weight percent relative to coal

EXAMPLE 36

Liquefaction of Alkylated Coal

Three coal samples were liquefied; each of these samples were run in duplicate with excellent reproducibility. The liquefaction was carried out at 425° C. using a two-fold excess of tetralin in a hydrogen atmosphere. The apparatus used was a tubing bomb unit (a batch liquefaction reactor). The residence time of the sample was two hours. One sample pair was Illinois No. 6 coal which was untreated. Another sample pair was Illinois No. 6 coal which was base treated, then acidified (BW/acidified). This second pair represents the coal used in the phase transfer alkylation or acylation except that no alkylating or acylating agent was used. It was a blank run sample in order to ensure that no other component of the phase transfer alkylation reaction conditions actually caused some effect on the liquefaction. The third sample pair was a phase transfer reactant O-perdeuteromethylated Illinois No. 6 coal with 4.5 $CD_3$ groups incorporated in the coal metrix for every 100 carbon atoms present. The percent conversion (on a dry mineral matter free basis) for each liquefaction was calculated by the following equation:

% Conversion (DMMF)=[100 (weight of chargeweight of residue)]/[weight of charge/(100−mineral matter)/100]

The values found are summarized in Table IV below.

TABLE IV

COAL CONVERSION

| Sample | % Conversion | Reproducbility |
|---|---|---|
| Illinois No. 6 Coal | 54.5 | ±1.5% |
| BW/Acidified Illinois No. 6 Coal | 56.8 | ±5.7% |
| O-Perdeuteromethylated Illinois No. 6 Coal | 74.5 | ±0.7% |

Mass spectrographic analysis of the gases produced in the three different liquefaction runs revealed some important information. First, only in the case of O-perdeutheromethylated Illinois No. 6 was there no water produced. This, of course, means that there was efficient use of hydrogen. Instead, this O-methylated coal produced a considerable increase in quality of gaseous hydrocarbons; that is, substantially no $CO_2$, $H_2S$, etc. was found. Methane (found with isotopic label), for example, was at a level of 300% above the other two sample types. In contrast, the untreated and the BW/acidified coal gave results very similar to each other. Much higher levels of ethane, propane and butane were also observed in the liquefaction of the perdeuteromethylated coal. However, the total quantity of gas produced in all three cases was about the same.

What is claimed is:

1. A method for improving the reactivity of coal and enhancing the yield and product quality upon liquefaction by oxygen-alkylation or oxygen-acylation, which method comprises: (a) contacting the coal with a solution comprising:

(aa) at least one quaternary base represented by the formula $R_4QOR''$ where each R is the same or different group selected from the group consisting of $C_1$ to about $C_{20}$ alkyl and $C_6$ to about $C_{20}$ aryl; Q is nitrogen or phosphorus; and R'' is selected from the group consisting of hydrogen, $C_1$ to about $C_{10}$, alkyl, aryl, alkylaryl, arylalkyl and acetyl; and (ab) at least one compound represented by the formula R'X where R' is a $C_1$ to $C_{20}$ alkyl or acyl group and X is selected from the group consisting of halides, sulfates, bisulfates, acetates and stearates; wherein C is attached to a primary or secondary carbon atom; and (b) subjecting the contacted coal to a liquefaction process.

2. The method of claim 1 hwerein R'' is a $C_1$ to $C_4$ alkyl group or hydrogen.

3. The method of claim 2 wherein R'' is hydrogen.

4. The method of claim 1 wherein Q is nitrogen.

5. The method of claim 3 wherein Q in nitrogen.

6. The method of claim 1 wherein each R is the same or different $C_1$ to $C_6$ alkyl group.

7. The method of claim 5 wherein each R is the same or different $C_1$ to $C_6$ alkyl group.

8. The method of claim 1 wherein R' is a $C_1$ to $C_4$ inert hydrocarbon group.

9. The method of claim 7 wherein R' is a $C_1$ to $C_4$ inert hydrocarbon.

10. The method of claim 1 wherein X is selected from the group consisting of chlorine, bromine and iodine.

11. The method of claim 9 wherein X is selected from the group consisting of chlorine, bromine and iodine.

12. The method of claim 11 wherein X is chlorine and R' is a methyl group.

13. The method of claim 1 wherein the amount of quaternary base ranges from about a stoichiometric amount to about 10 times the total number of acidic sites on the coal.

14. The method of claim 12 wherein the amount of quaternary base ranges from about a stoichiometric amount to about 10 times the total number of acidic sites on the coal.

15. The method of claim 1 wherein R'X is present in at least a stoichiometric amount relative to the number of acidic sites on the coal.

16. The method of claim 14 wherein R'X is present in at least stoichiometric amounts relative to the number of acidic sites on the coal.

17. The method of claim 1 wherein a quaternary salt represented by the formula $R_4QX$ is reacted with an alkali or alkaline earth metal base represented by the formula MOR'' to form the corresponding quaternary base, wherein M is an alkali or alkaline earth metal.

18. The method of claim 16 wherein a quaternary salt represented by the formula $R_4QX$ is reacted with an alkali or alkaline earth metal base represented by the formula MOR'' to form the corresponding quaternary base, wherein M is an alkali or alkaline earth metal.

19. The method of claim 17 which is repeated at least once.

20. The method of claim 18 which is repeated at least once.

21. The method oc claim 1 wherein at least a portion of of the treated coal is liquefied at temperatures ranging from about 310° to about 540° C. and pressures of about 300 to about 3000 psig in the presence of at least one of a hydrogen donor solvent and molecular hydrogen.

22. The method of claim 21 wherein the liquefaction conditions include elevated temperatures and pressures and the presence of a hydrogen donor solvent boiling in the range of about 150° C. to about 510° C.

* * * * *